US007594708B2

(12) United States Patent
Barkley et al.

(10) Patent No.: US 7,594,708 B2
(45) **Date of Patent: *Sep. 29, 2009**

(54) METHODS AND APPARATUSES FOR SENSING TEMPERATURE OF MULTI-VIA HEATER CHIPS

(75) Inventors: Lucas David Barkley, Lexington, KY (US); Bruce David Gibson, Lexington, KY (US); Eric Spencer Hall, Lexington, KY (US); David G. King, Shelbyville, KY (US); George K. Parish, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 154 days.

This patent is subject to a terminal disclaimer.

(21) Appl. No.: 11/323,809

(22) Filed: Dec. 30, 2005

(65) Prior Publication Data

US 2007/0153044 A1 Jul. 5, 2007

(51) Int. Cl.
*B41J 29/38* (2006.01)

(52) U.S. Cl. ..... 347/17; 347/12; 347/5

(58) Field of Classification Search ..... 345/5, 345/9, 12, 14, 17, 19; 347/40, 42
See application file for complete search history.

(56) References Cited

U.S. PATENT DOCUMENTS

| | | | |
|---|---|---|---|
| 5,594,488 | A | 1/1997 | Tsushima et al. |
| 5,646,660 | A | 7/1997 | Murray |
| 5,731,828 | A | 3/1998 | Ishinaga et al. |
| 5,812,162 | A | 9/1998 | Silverbrook |
| 6,260,952 | B1 | 7/2001 | Feinn et al. |
| 6,357,863 | B1 | 3/2002 | Anderson et al. |
| 6,382,773 | B1 | 5/2002 | Chang et al. |
| 6,386,674 | B1 | 5/2002 | Corrigan et al. |
| 6,398,347 | B1 | 6/2002 | Torgerson et al. |
| 6,474,782 | B1 | 11/2002 | Furukawa |
| 6,488,363 | B2 | 12/2002 | Torgerson et al. |
| 6,499,834 | B2 | 12/2002 | Takizawa |
| 6,601,941 | B1 | 8/2003 | Jones et al. |
| 6,641,242 | B2 | 11/2003 | Canti et al. |
| 6,644,774 | B1 | 11/2003 | Burger et al. |
| 6,663,227 | B2 | 12/2003 | Yamamoto et al. |
| 6,764,163 | B2 | 7/2004 | Anderson et al. |
| 6,808,243 | B1 | 10/2004 | Markham et al. |
| 6,871,929 | B2 | 3/2005 | Crivelli et al. |
| 6,883,904 | B2 | 4/2005 | Jeanmaire et al. |
| 6,890,064 | B2 | 5/2005 | Torgerson et al. |
| 6,951,378 | B1 | 10/2005 | Yamada et al. |
| 2003/0142159 | A1 | 7/2003 | Askeland et al. |

(Continued)

FOREIGN PATENT DOCUMENTS

| | | |
|---|---|---|
| JP | 11-254409 | 9/1999 |

*Primary Examiner*—Lam S Nguyen
(74) *Attorney, Agent, or Firm*—Sutherland, Asbill & Brennan

(57) ABSTRACT

Heater chips for use with a printing device, such as heater chips that include a first heater array, positioned substantially adjacent a first via, and a second heater array, positioned substantially adjacent a second via. The heater chip can also include a region, positioned between the first heater array and the second heater array, and a temperature sensing element operable to sense the temperature of the region, where the temperature sensing element is substantially centrally disposed with respect to the region. According to one embodiment of the invention, the temperature sensing element comprises a temperature sensing resistor.

15 Claims, 5 Drawing Sheets

U.S. PATENT DOCUMENTS

2005/0052500 A1* 3/2005 Edelen et al. ..... 347/61
2005/0162450 A1 7/2005 Sakurai
2005/0185023 A1 8/2005 Furukawa et al.
2007/0153045 A1 7/2007 Barkley et al.

* cited by examiner

METHODS AND APPARATUSES FOR SENSING TEMPERATURE OF MULTI-VIA HEATER CHIPS

CROSS REFERENCE TO RELATED APPLICATIONS

This application is related to U.S. patent application Ser. No. 11/324,167, filed contemporaneously herewith, and entitled "Methods and Apparatuses for Regulating the Temperature of Multi-Via Heater Chips."

FIELD OF THE INVENTION

The present invention relates generally to printing devices, and more particularly to methods and apparatuses for sensing temperature of multi-via heater chips.

BACKGROUND OF THE INVENTION

A number of printers, copiers, and multi-function products utilize heater chips in their printing heads for discharging ink drops. The ink is supplied through one or more ink vias in the chip. These heater chips typically provide only one heater array for each ink via that is disposed along one side of the ink via. In particular, as shown in FIG. 1, a traditional heater chip 100 may include three ink vias—a cyan ink via 102, a magenta ink via 104, and a yellow ink via 106. The cyan ink via 102 operates with the cyan heater array 108; the magenta ink via 104 operates with the magenta heater array 110; and the yellow ink via 106 operates with the yellow heater array 112.

Similarly, FIG. 2 shows a heater chip which includes three ink vias, each connected to a single heater array. The cyan ink via 202 operates with the cyan heater array 208; the magenta ink via 204 operates with the magenta heater array 210; and the yellow ink via 206 operates with the yellow heater array 212. However, the traditional use of single heater array on a single side of an ink via limits the achievable printing resolution, including the vertical resolution. The configurations shown in FIG. 1 and FIG. 2 may have significant difficulty providing ink drop sizes of less than 4 pL (picoliters) while achieving a vertical resolution of about 1200 dpi (dots per inch) or better. Therefore, it is desirable to position heater arrays on both sides of the ink vias, which allow the ink vias to provide smaller ink drops in order to achieve higher printing resolutions.

Additionally, for proper functionality, inkjet heater chips need to monitor and maintain the silicon substrate of the heater chip at an acceptable temperature for printing. If the temperature is too low, the ink drops formed will be smaller and have a lower drop-weight than that required for good image quality. As the temperature rises, the drop-weight of the ink drop will rise. Variations in drop-weight will cause visible hue shifts in the printed image.

A thermal sense resistor (TSR) is typically used to sense the temperature of the silicon substrate. The temperature of the heater chip shown in FIG. 1 is measured by way of a metal serpentine temperature sense resistor 120. The serpentine temperature sense resistor 120 is routed around the periphery of the heater chip and provides an average temperature of the entire die. This average measurement provides no discrimination between individual colors and does not provide any feedback on temperature differences between one area of the heater chip versus another. Thus, the metal serpentine temperature sense resistor 120 lacks the ability to control temperature on a per color or area basis.

The heater chip shown in FIG. 2 improves on that of FIG. 1 by providing for temperature sensing on a per color basis. Three temperature sense resistors 220, 222, and 224 are placed in close proximity to each of the heater arrays, each situated on the same side of their respective ink vias. As shown, a first TSR 220 is situated on the left side of the cyan ink via 202 and cyan heater array 208; a second TSR 222 is situated on the left side of the magenta ink via 204 and magenta heater array 210; and a third TSR 224 is situated on the left side of the yellow ink via 206 and the yellow heater array 212. The ink vias 202, 204, and 206 act as a thermal barrier between the colors. All the thermal heater arrays 208, 210, and 212 are situated on only one side of their respective ink vias, ensuring that there is only a small amount of thermal crosstalk between the temperature sense resistors.

Once the temperature within the heater chip is measured, the temperature can be maintained and regulated at an acceptable temperature for printing. Some traditional heater chips use substrate heating elements to heat the silicon substrate to an acceptable temperature. Other heater chips apply fire pulses to selected heater arrays of a short duration to maintain desired temperature. The duration of the fire pulses is too short to cause the nucleation and subsequent ejection of an ink drop, but the pulses are sufficient to ensure that the heater chip operates within an acceptable temperature range.

In FIG. 2, fire pulses may be applied on a per color basis from the respective heater arrays 208, 210, and 212. As previously mentioned, the ink vias 202, 204, and 206 function as thermal barriers between the colors. For example, heat generated by the magenta heater array 210 will not readily couple to the cyan heater array 208 and yellow heater array 212 on either side across the intervening ink vias 202 and 204. Thus, an adequate operating temperature can be maintained for each color of the heater chip.

When a heater array is positioned on both sides of an ink vias, the temperature sensing and regulating devices utilized in the prior art do not provide adequate thermal control. A serpentine temperature sense resistor 120, as depicted in FIG. 1 is not capable of discriminating between the individual colors of the heater arrays and does not provide any feedback on temperature difference between various areas of the heater chip. Further, monitoring and regulating the operating temperature on a per color basis by situating a temperature sense resistor on the same side of each respective ink via, as shown in FIG. 2, is insufficient due to the fact that heater arrays of more than one color now occupy the silicon region between ink vias. Without accurate temperature readings, the method of providing fire pulses to regulate thermal conditions on a per color basis would also be subject to error.

Accordingly, there is a need in the industry for heater chips that can provide for monitoring and regulating the various regions of a heater chip at a desired temperature when heater arrays are placed on both sides of the ink vias.

BRIEF SUMMARY OF THE INVENTION

According to one embodiment of the present invention, there is disclosed a chip for use with a printing device. The chip includes a first heater array, positioned substantially adjacent a first via, and a second heater array, positioned substantially adjacent a second via. The chip also includes a region, positioned between the first heater array and the second heater array, and a temperature sensing element operable to sense the temperature of the region, where the temperature sensing element is substantially centrally disposed with respect to the region.

According to one embodiment, the temperature sensing element may include a temperature sensing resistor. The temperature sensing element may also include a thermal sense resistor, such as an n-type implant donor thermal sensing resistor. According to another embodiment of the invention, the temperature sensing element may be positioned several hundred microns, such as at least 300 microns, from both the first heater array and the second heater array. According to yet another embodiment of the invention, the temperature sensing element is positioned substantially planar to each of the first heater array and the second heater array such that the temperature sensing element is not positioned directly above the first or second heater arrays.

According to another embodiment of the invention, the chip may include at least one control element operable to receive a temperature measured by the temperature sensing element. Additionally, the chip may include a third heater array, positioned substantially adjacent the second via, and a fourth heater array, positioned substantially adjacent a third via. The chip may also include a second region, positioned between the third heater array and the fourth heater array, and a second temperature sensing element operable to sense the temperature of the second region, where the temperature sensing element is substantially centrally disposed with respect to the second region. Furthermore, the temperature sensing element positioned between the first heater array and the second heater array may be different than the second temperature sensing element positioned between the third heater array and the fourth heater array.

According to another embodiment of the invention, there is disclosed a method of fabricating chips for use with a printing device. The method includes providing a first heater array, positioned substantially adjacent a first via, and providing a second heater array, positioned substantially adjacent a second via. The method also includes positioning a temperature sensing element in a region between the first heater array and the second heater array, where the temperature sensing element is operable to sense the temperature of the region.

According to one embodiment, positioning a temperature sensing element in the region includes positioning a temperature sensing element in substantially the center of the region. According to another embodiment of the invention, positioning a temperature sensing element in the region includes positioning a temperature sensing resistor in the region. Positioning a temperature sensing element in the region may also include positioning a thermal sense resistor in the region. Additionally, positioning a temperature sensing element in the region may also include positioning an n-type implant donor thermal sensing resistor in the region.

According to yet another embodiment of the invention, positioning a temperature sensing element in the region between the first heater array and the second heater array includes positioning the temperature sensing element several hundred microns, such as at least 300 microns, from each of the first heater array and the second heater array. Additionally, positioning a temperature sensing element in the region between the first heater array and the second heater array may include positioning the temperature sensing element substantially planar to each of the first heater array and the second heater array such that the temperature sensing element is not positioned directly above the first or second heater arrays.

According to yet another embodiment of the invention, the method may include providing at least one control element operable to receive a temperature measured by the temperature sensing element. The method may also include providing a third heater array substantially adjacent the second via, providing a fourth heater array substantially adjacent a third via, and positioning a second temperature sensing element in a second region located between the third heater array and the fourth heater array, where the temperature sensing element is operable to sense the temperature of the second region, and where the temperature sensing element is substantially centrally disposed with respect to the second region. Additionally, the temperature sensing element positioned between the first heater array and the second heater array may be different than the second temperature sensing element positioned between the third heater array and the fourth heater array.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF EXEMPLARY EMBODIMENTS OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

According to an exemplary embodiment of the present invention, heater arrays may be positioned on both sides of at least a portion of the ink vias, which can allow higher printing resolutions. Each of these heater arrays may include a plurality of individual heaters fabricated as resistors in the heater chips. For example, these resistors may be thin-film resistors in accordance with an exemplary embodiment of the invention. These thin-film resistors may be formed of a variety of materials, including platinum, aluminum, alloys, and other materials. The heaters may also be formed of other technologies besides thin-film resistors, as are known to those of ordinary skill in the art. When the heaters in the heater arrays are activated, they provide thermal energy to the nozzle chamber, and the ink is discharged through the nozzle.

Figure 3:
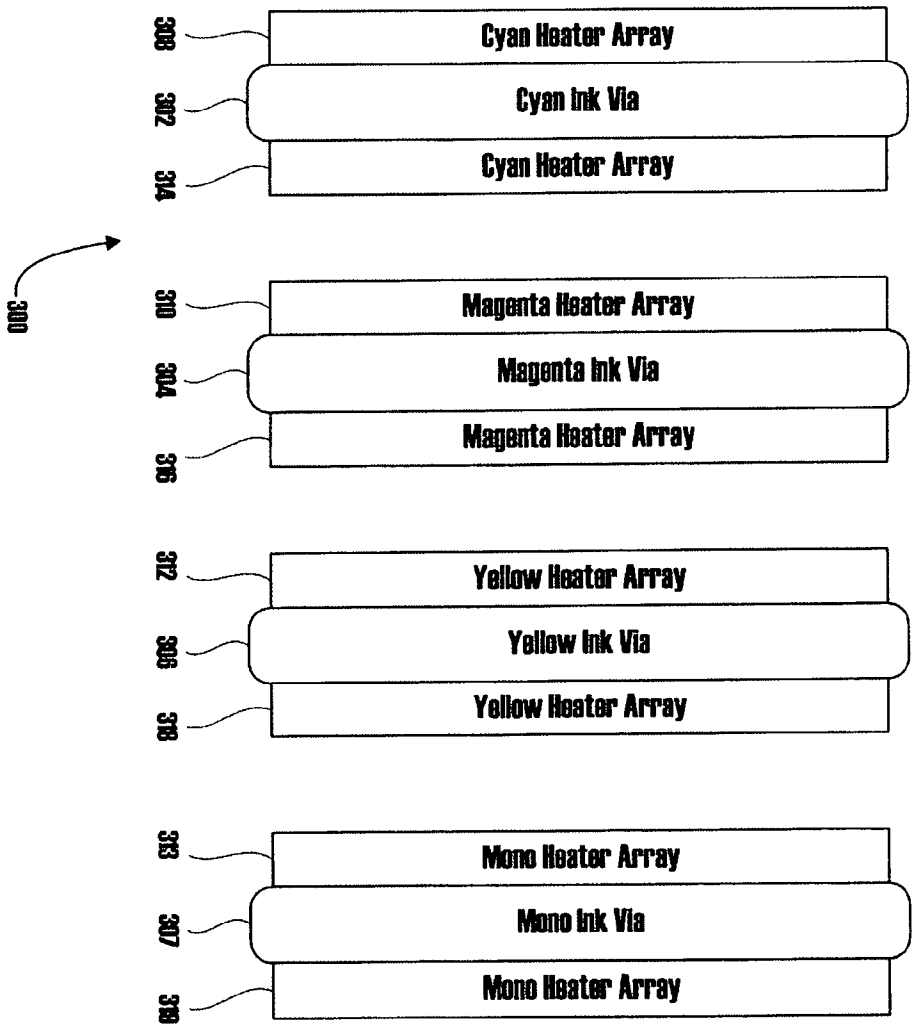
FIG. 3 illustrates an exemplary configuration for a heater chip having a heater array positioned on both sides of each ink via, according to an illustrative embodiment of the present invention.

FIG. 3 shows an illustrative heater chip 300 according to an embodiment of the present invention. The heater chip 300 illustrates the placement of a single via in between two corresponding heater arrays. With the heater arrays positioned on both sides of at least a portion of the ink vias, higher printing resolutions can be achieved. As shown in FIG. 3, the illustrative heater chip 300 is a CMYK (cyan-magenta-yellow-monochrome) heater chip that includes four ink vias each disposed between two heater arrays. In particular, a cyan ink via 302 is positioned between a first heater array 308 and a second heater array 314; a magenta ink via 304 is positioned between a first heater array 310 and a second heater array 316; a yellow ink via 306 is positioned between a first heater array 312 and a second heater array 318; and a monochrome (K) ink via 307 is positioned between a first heater array 313 and a second heater array 319.

Although the heater chip 300 illustrated in FIG. 3 shows only four ink vias, it will be appreciated by one of ordinary skill in the art that a greater number of vias and corresponding heater arrays may be utilized. As an example, an additional monochrome (K) ink via may be disposed between two additional heater arrays to form a CMYKK heater chip. Additionally, there may be numerous vias for a particular color within a heater chip. According to another embodiment of the invention, only some of the ink vias may be disposed between two heater arrays. For example, the monochrome ink via 307 may include only one monochrome heater array along a single side of the monochrome ink via 307.

The heater arrays 308, 310, 312, 313, 314, 316, 318, 319 shown in FIG. 3 may include one or more individual heaters fabricated as resistors in the heater chip. These resistors may be thin-film resistors in accordance with an exemplary embodiment of the invention. Thin-film resistors may be formed of one or more materials, including platinum (Pt), gold (Au), silver (Ag), copper (Cu), aluminum (Al), tantalum (Ta), titanium tungsten (TiW), silicon-nitrogen (SiN), silicon carbide (SiC), diamond-like carbon (DLC) coating, etc. Other metals, alloys, or materials appreciable by one of ordinary skill in the art may also be used. The heater arrays may also be formed of other technologies besides thin-film resistors, as is known to those of ordinary skill in the art.

Figure 1:
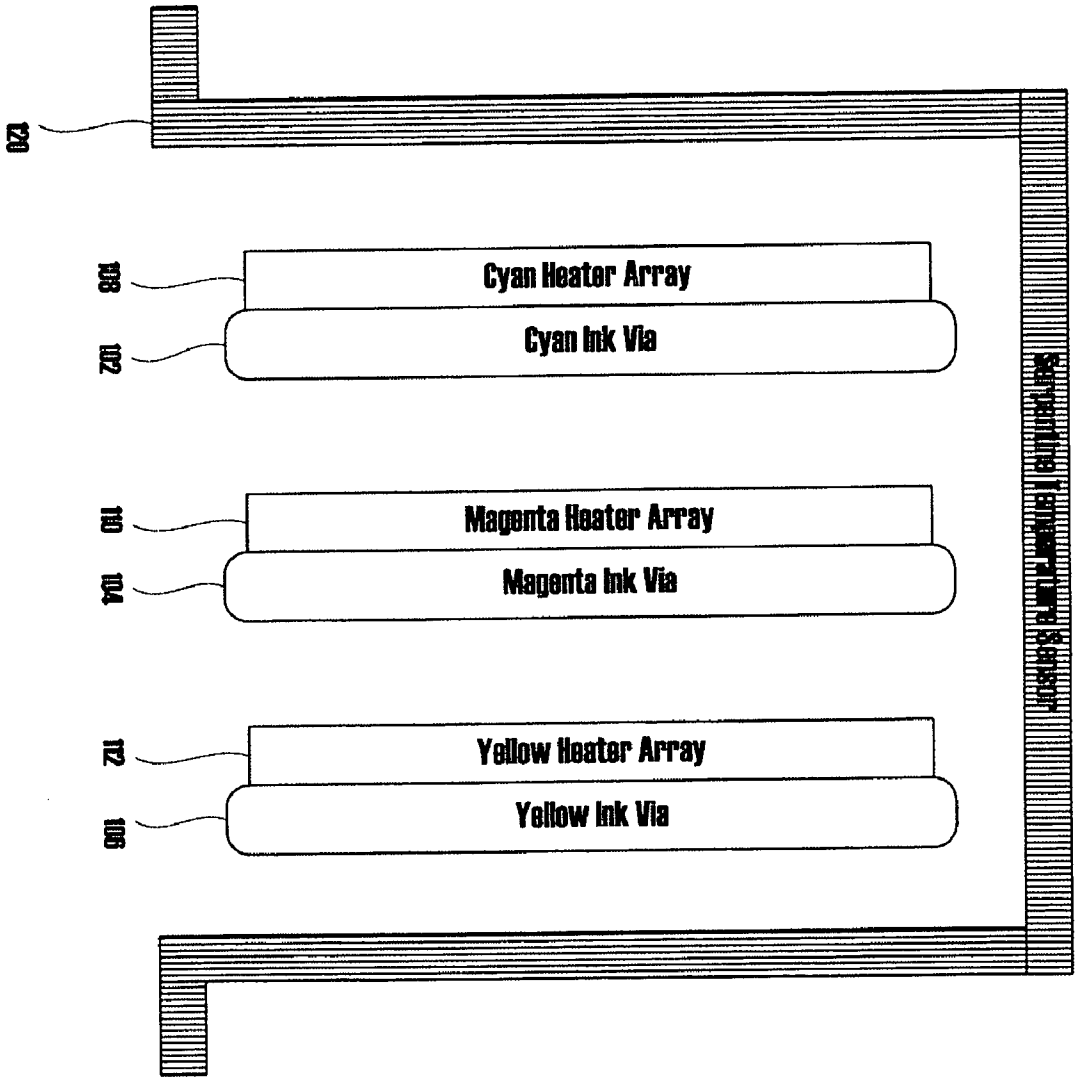
FIG. 1 (Prior Art)
FIG. 1 illustrates a traditional heater chip utilizing a serpentine temperature sense resistor for providing an average temperature of the entire die.
Figure 2:
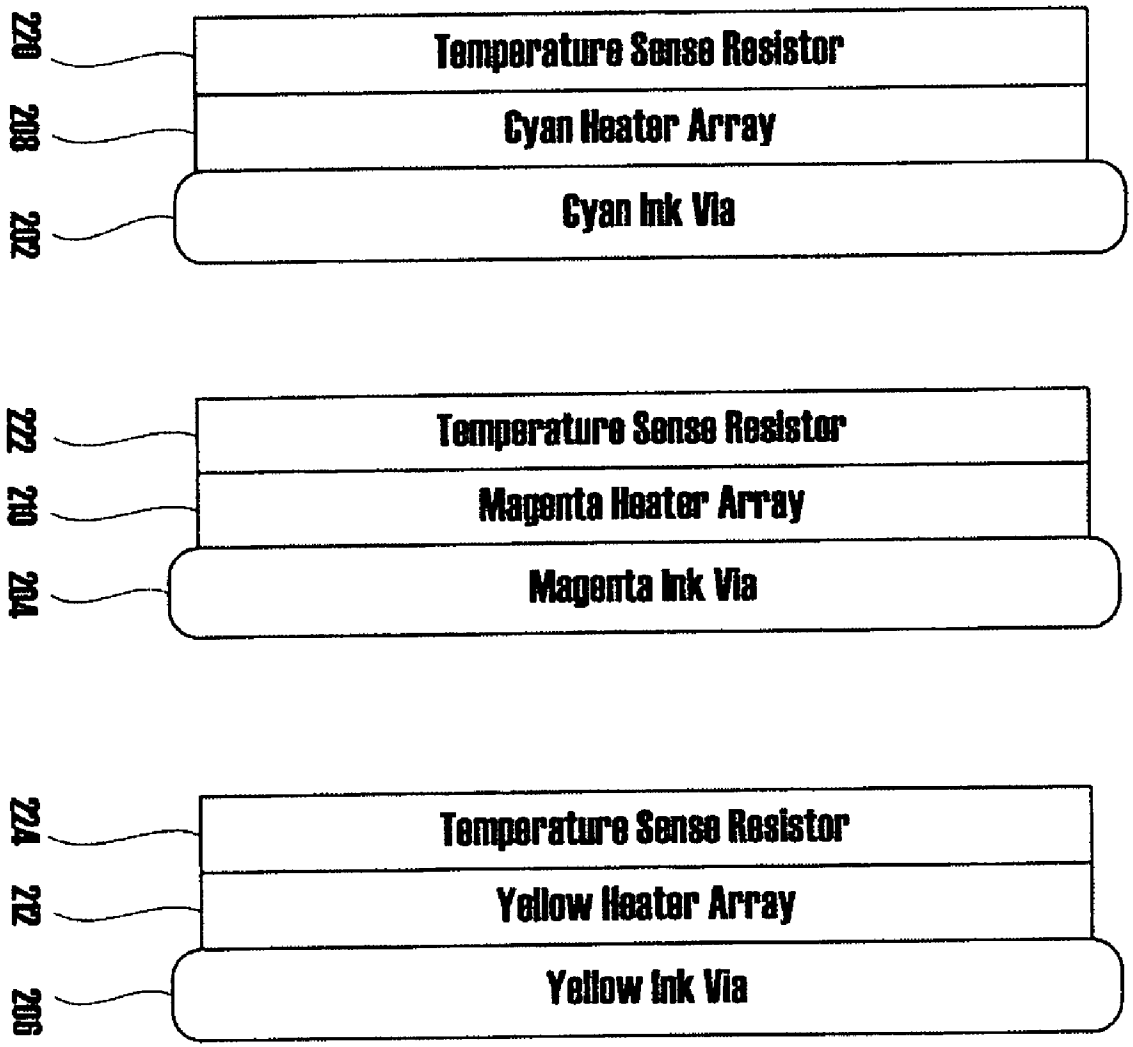
FIG. 2 (Prior Art)
FIG. 2 illustrates a traditional heater chip utilizing temperature sense resistors and heater arrays to monitor and regulate temperature on a by color basis.

It will be appreciated that the placement of a single via in between two heater arrays presents a challenge in attempting to sense the temperature of individual colors. If there is a single TSR associated with each heater array in the illustrative embodiment of FIG. 2, then two TSRs will be placed next to each other between adjacent ink vias. For instance, if one TSR is associated with the left yellow heater array and another TSR is associated with the right magenta heater array, the region between the magenta and yellow vias would include two TSRs. If a print job is heavy in yellow and light in magenta, the thermal energy generated by the yellow heaters would rapidly couple through the common silicon to the magenta TSR positioned in between the yellow and magenta ink vias, providing a false high reading for magenta. Rather than try to sense temperature on a per color basis with TSR's in close proximity to heaters, the present invention senses temperature by silicon region.

Figure 4:
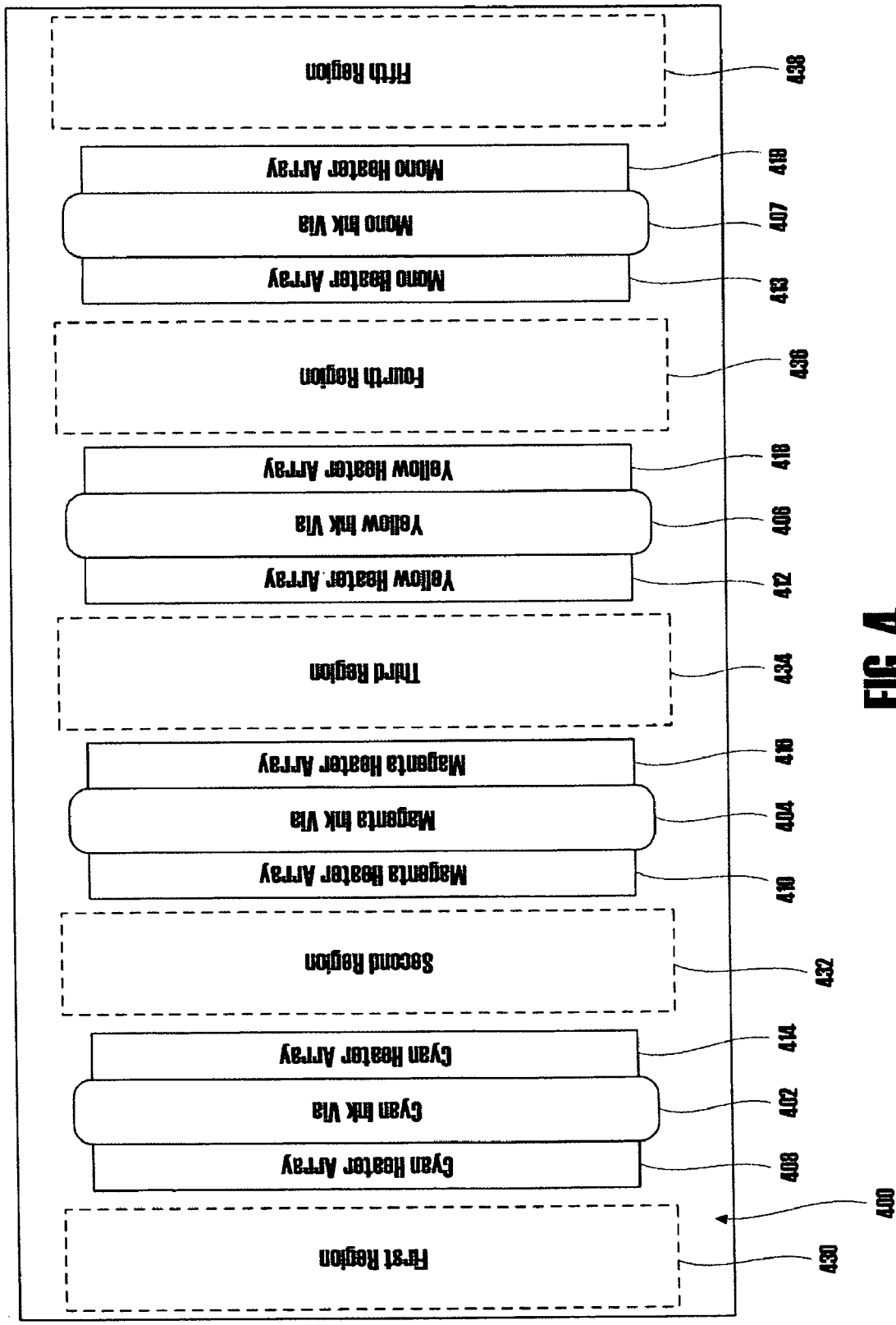
FIG. 4 illustrates an exemplary configuration for a heater chip having regions defined between the ink vias, according to an illustrative embodiment of the present invention.

According to an exemplary embodiment of the present invention, an adequate operating temperature is monitored and regulated for various thermal regions separated by insulating ink vias on the heater chip. FIG. 4 illustrates an exemplary configuration for a heater chip 400 having thermal regions defined between the ink vias, according to one embodiment of the present invention. In particular, a first region 430 is defined as the area between the left edge of the heater chip 400 and the cyan ink via 402; a second region 432 is defined as the area between the cyan ink via 402 and the magenta ink via 404; a third region 434 is defined as the area between the magenta ink via 404 and the yellow ink via 406; a fourth region 436 is defined as the area between the yellow ink via 406 and the mono ink via 407; and a fifth region 438 is defined as the area between the mono ink via 407 and the right edge of the heater chip 400. It will be understood by those of ordinary skill in the art that any number of thermal regions may be defined for monitoring and regulating temperature on the heater chip.

The heater chip 400 includes components, such as the ink vias 402, 404, 406, 407 and heater arrays 408, 414, 410, 416, 412, 418, 413, 419 connected to a substrate (not shown) made up of a semiconductor material. According to an exemplary embodiment of the present invention, the substrate may be a silicon substrate. It will be appreciated by those skilled in the art, however, that the substrate can be formed from a variety of solid crystalline substances used as a base material for electronic devices, such as germanium (Ge), having electrical conductivity greater than insulators but less than good conductors. The thermal regions 430, 432, 434, 436, and 438 are defined regions of the silicon substrate of the heater chip 400 situated around and between the ink vias 402, 404, 406, and 407. The minimum width of the thermal regions 430, 432, 434, 436, and 438 is generally limited by the heater chip 400 circuitry.

According to an exemplary embodiment of the present invention, temperature of the heater chip 400 is measured on a per thermal region basis. A temperature sensing element is placed in each of the thermal regions, and each is operable to measure the temperature of the silicon substrate in a corresponding thermal region. According to an exemplary embodiment of the present invention, the temperature sensing elements are n-type implant donor thermal sensing resistors (NSD sense resistors), as will be understood by those skilled in the art. As the substrate temperature of the heater chip 400 increases, the resistance of the TSRs increases, allowing a temperature measurement to be taken. It will also be appreciated by those of ordinary skill in the art that many other temperature sensing elements can be used, including but not limited to metal resistors and p-type implant donors.

Figure 5:
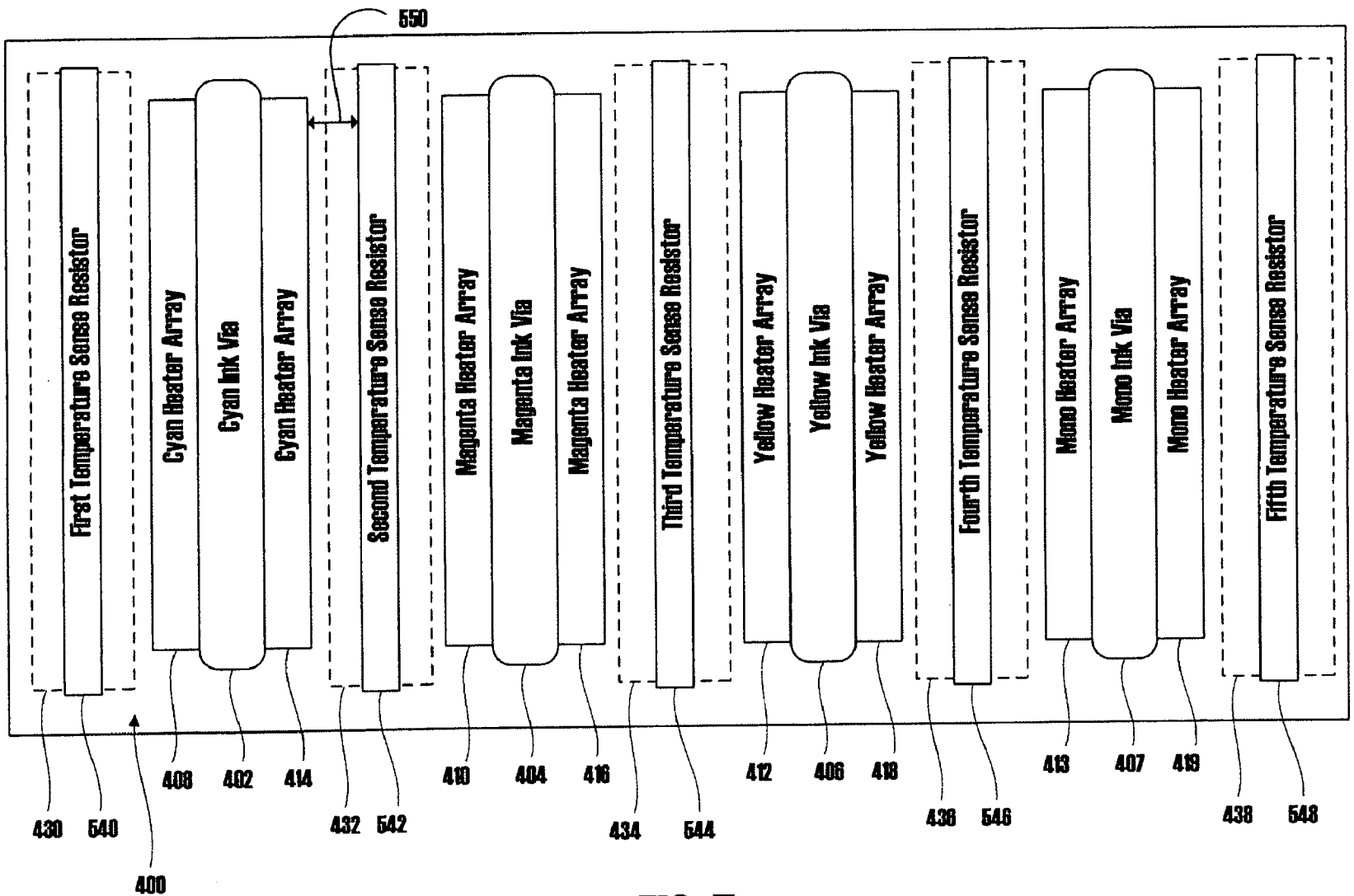
FIG. 5 illustrates an exemplary configuration for a heater chip in accordance with an illustrative embodiment of the present invention.

With particular reference to FIG. 5, a TSR is positioned within each of the thermal regions 430, 432, 434, 436, 438. Thus, a first TSR 540 is situated in the first region 430; a second TSR 542 is situated in the second region 432; a third TSR 544 is situated in the third region 434; a fourth TSR 546 is situated in the fourth region 436; and a fifth TSR 548 is situated in the fifth region 438. The TSRs 540, 542, 544, 546, and 548 are placed well away from the heater arrays 408, 410, 412, 413, 414, 416, 418, 419, at a distance 550 of several hundred microns, rather than in close proximity to the heater arrays. For the first region 430 the first TSR 440 is centered between the left edge (i.e., the left edge of the substrate) of the heater chip 400 and the cyan ink via 402. Similarly, for the fifth region 438 the fifth TSR 448 is centered between the right edge of the heater chip 400 and the mono ink via 402. The remaining TSRs 542, 544, 546 are centered between heater arrays from adjacent ink vias corresponding to different colors (i.e., heater arrays 414 and 410, 416 and 412, and 418 and 413, respectively). It will be understood by those skilled in the art that the TSRs 540, 542, 544, 546, and 548 need not be centered within their respective thermal regions 430, 432, 434, 436, and 438, but rather, they can be positioned at any point within their respective thermal regions.

Due to the relative high thermal conductivity of the silicon substrate, each of the thermal regions 430, 432, 434, 436, 438 have a very uniform temperature across the width of that region. Because of this conductivity, the TSRs 540, 542, 544, 546, 548 can be placed in the center of their respective thermal regions 430, 432, 434, 436, and 438 and still provide an accurate temperature measurement for the region. The ink vias 402, 404, 406, 407, on the other hand, act as thermal insulators between the thermal regions 430, 432, 434, 436, 438. As an example, if the right cyan heater array 414 fires, then the adjacent left magenta heater array 410 will quickly be at the same temperature as the right cyan heater array 414. A temperature reading from the second region 432 represents the temperature of both the magenta and cyan heater arrays 414 and 410 in the second region. As previously mentioned, the minimum width of the thermal regions 430, 432, 434, 436, and 438 is generally limited by the heater chip 400 circuitry. It will be appreciated by those of ordinary skill in the art that the maximum practical width for temperature sensing accuracy depends on a combination of the printing rate and the frequency at which the temperature is read from a thermal region. For instance, if the right cyan heater array 414 is firing at a high frequency, then the width of the second region 432 would need to be small enough to ensure uniform temperature across the second region 432 for a given temperature sampling rate of the second TSR 542.

According to one embodiment of the invention, each TSR 540, 542, 544, 546, 548 makes up half of a wheatstone bridge circuit, as is known to those of ordinary skill in the art for use in measuring small changes in resistance. The other half of the bridge circuit feeds into a differential op-amp, the output of which is provided as input to an A/D converter. The A/D converter may be included in an Application Specific Integrated Circuit (ASIC) that controls the functioning of the printhead. Firmware running on the system, in conjunction with the ASIC may monitor the measured temperature from each TSR. According to one embodiment of the invention, the temperature may be monitored continuously prior to the beginning of printing. As described in detail below, this information can allow the heater arrays to be fired at a high frequency to maintain a desired temperature in each region. According to another embodiment of the invention, the monitoring of temperature in each region may not be monitored during printing.

According to yet another embodiment of the present invention, the temperature of the heater chip 400 is regulated on a per region basis. The heater chip 400 may use non-nucleating heating (NNH) to maintain an adequate substrate temperature for the heater chip 400 in each region in order to ensure the best print quality. NNH includes applying fire pulses to selected heater arrays 408, 410, 412, 413, 414, 416, 418 of a duration too short to cause nucleation and the subsequent ejection of an ink drop from an ink via 402, 404, 406, and 407. NNH is applied on a per thermal region basis rather than on a per color basis. According to one embodiment of the invention, NNH pulses are applied to heaters within each region. Additionally, the heaters used in each region may vary, and the firing of pulses in two or more heaters may be asynchronous to minimize the current and power required for maintaining a desired temperature in each region. Instructions for firing heaters may be provided via one or more data streams used to control heater address data, the printhead, and like elements. Those skilled in the art will recognize that other methods for heating the various thermal areas can be used, including but not limited to substrate heating elements.

As shown in FIG. 5, the first region 430 is heated by the left cyan heater array 408; the second region 432 is heated by the right cyan heater array 414 and the left magenta heater array 410; the third region 434 is heated by the right magenta heater array 416 and the left yellow heater array 412; the fourth region 436 is heated by the left yellow heater array 418 and the mono heater array 413; and the fifth region 438 is heated by the right mono heater array 419. According to one embodiment of the invention, one or more of the regions may not be heated by both adjacent heater arrays due to hardware constraints. For instance, the fourth region 436 may be heated only by the left mono heater array 413 rather than by both the left mono heater array 413 and the right yellow heater array 418. As described above, the firing of pulses in two or more heaters may be asynchronous to minimize the current and power required for maintaining a desired temperature in each region. Based on the average thermal region temperature measurements provided by the TSRs 540, 542, 544, 546, 548, if heating is required in a particular thermal region, NNH is applied to each heater array situated in that thermal region. Thus, each thermal region can be regulated at its optimal operating temperature.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A chip for use with a printing device, comprising:

a plurality of ink vias arranged parallel to one another, each of the ink via having two longitudinal sides;

a heater array disposed adjacent each longitudinal side of the ink vias such that each ink via is associated with two heater arrays disposed adjacent the two longitudinal sides of the ink via;

a region disposed adjacent each heater array, wherein only one region is disposed between two adjacent ink vias and wherein the region disposed between two adjacent ink vias includes two heater arrays each heater array being associated with their respective ink via; and a single temperature sensing element disposed within each region, the temperature sensing element operable to sense a temperature representative of the heater arrays adjacent to the region and disposed at a predetermined distance away from adjacent heater arrays.

2. The chip of claim 1, wherein the temperature sensing element comprises a temperature sensing resistor.

3. The chip of claim 2, wherein the temperature sensing element comprises a thermal sense resistor.

4. The chip of claim 3, wherein the temperature sensing element comprises an n-type implant donor thermal sensing resistor.

5. The chip of claim 1, wherein the predetermined distance is at least 300 microns.

6. The chip of claim 1, wherein the temperature sensing element is positioned substantially planar to each of the adjacent heater arrays.

7. The chip of claim 1, further comprising at least one control element operable to receive a temperature measured by the temperature sensing element.

8. The chip of claim 1, wherein the chip has at least one edge and at least one region is disposed between one of the plurality of ink vias and the at least one edge.

9. A method of fabricating chips for use with a printing device, comprising:

arranging a plurality of ink vias parallel to one another, wherein each of the ink via has two longitudinal sides;

placing a heater array adjacent each longitudinal side of the ink via such that each ink via is associated with two heater arrays placed adjacent its longitudinal sides;

defining a region adjacent each heater array such that there is only one region between two ink vias and the region between two adjacent ink vias includes arrays each heater array being associated with its respective ink via; and positioning a single temperature sensing element disposed within each region, wherein the temperature sensing element is operable to sense a temperature representative of the heater arrays adjacent to the region and is disposed at a predetermined distance away from adjacent heater arrays.

10. The method of claim 9, wherein positioning a temperature sensing element in the region comprises positioning a temperature sensing element in substantially a center portion of the region.

11. The method of claim 9, wherein positioning a temperature sensing element in the region comprises positioning a temperature sensing resistor in the region.

12. The method of claim 9, wherein positioning a temperature sensing element in the region comprises positioning a thermal sense resistor in the region.

13. The method of claim 11, wherein positioning a temperature sensing element in the region comprises positioning an n-type implant donor thermal sensing resistor in the region.

14. The method of claim 9, wherein positioning a temperature sensing element in the region between the adjacent heater arrays comprises positioning the temperature sensing element at least 300 microns from each of the adjacent heater arrays.

15. The method of claim 9, wherein positioning a temperature sensing element in the region between the adjacent heater arrays comprises positioning the temperature sensing element substantially planar to each of the heater arrays.

* * * * *